US007219730B2

(12) United States Patent
Tilton et al.

(10) Patent No.: US 7,219,730 B2
(45) Date of Patent: May 22, 2007

(54) SMART CEMENTING SYSTEMS

(75) Inventors: Frederick T. Tilton, Spring, TX (US); Brent J. Lirette, Houston, TX (US); James G. Martens, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 472 days.

(21) Appl. No.: 10/259,214

(22) Filed: Sep. 27, 2002

(65) Prior Publication Data

US 2004/0060697 A1 Apr. 1, 2004

(51) Int. Cl.
*E21B 47/09* (2006.01)
*E21B 47/01* (2006.01)
*E21B 33/13* (2006.01)
*E21B 33/16* (2006.01)

(52) U.S. Cl. ..... 166/255.1; 166/386; 166/250.01

(58) Field of Classification Search ..... 166/253.1, 166/255.1, 317, 65.1, 386, 66, 250.01, 281
See application file for complete search history.

(56) References Cited

U.S. PATENT DOCUMENTS

| | | | | |
|---|---|---|---|---|
| 1,369,891 A | * | 3/1921 | Halliburton | 166/253.1 |
| 2,104,270 A | * | 1/1938 | Owsley | 166/285 |
| 2,324,698 A | * | 7/1943 | Hart | 33/715 |
| 2,607,222 A | * | 8/1952 | Lane | 73/152.26 |
| 2,681,567 A | * | 6/1954 | Widess | 73/152.46 |
| 3,022,822 A | * | 2/1962 | Loy Ill et al. | 166/250.01 |
| 3,426,204 A | * | 2/1969 | Sutton | 250/260 |
| 3,457,994 A | | 7/1969 | Stachowiak | 166/125 |
| 4,070,734 A | * | 1/1978 | Paden et al. | 24/28 |
| 4,121,657 A | | 10/1978 | McClure | |
| 4,206,810 A | | 6/1980 | Blackman | |
| 4,389,645 A | | 6/1983 | Wharton | |
| 4,403,659 A | | 9/1983 | Upchurch | 166/374 |
| 4,722,603 A | * | 2/1988 | Graebner et al. | 356/477 |
| 4,796,699 A | | 1/1989 | Upchurch | 166/250 |
| 4,819,726 A | * | 4/1989 | Beirute et al. | 166/291 |

(Continued)

FOREIGN PATENT DOCUMENTS

| | | | |
|---|---|---|---|
| SU | 1439225 A | * | 11/1988 |
| WO | WO 02/059458 | | 8/2002 |

OTHER PUBLICATIONS

U.S. Appl. No. 60/332,478, filed Nov. 2001, Bussear et al.*

(Continued)

*Primary Examiner*—David Bagnell
*Assistant Examiner*—Shane Bomar
(74) *Attorney, Agent, or Firm*—Patterson & Sheridan, L.L.P.

(57) ABSTRACT

The present invention provides methods and apparatus for determining the location of an apparatus in a wellbore. The method includes lowering the apparatus with a conveying member and measuring a parameter associated with the conveying member. Thereafter, the measured parameter is used to determine the location of the apparatus as well as other conditions in the wellbore. The apparatus includes a conveying member operatively connected to an object released downhole. The apparatus may also include a dispensing apparatus coupled to one end of the conveying member. Preferably, the conveying member is a fiber optics line capable of transmitting optical signals. Other types of conveying members include a wire, a tube, and a cable. Additionally, a sensor may be disposed on the object and connected to the conveying member.

29 Claims, 6 Drawing Sheets

U.S. PATENT DOCUMENTS

| | | | | |
|---|---|---|---|---|
| 4,856,595 | A | 8/1989 | Upchurch | 166/374 |
| 5,094,103 | A * | 3/1992 | Wicks et al. | 73/152.31 |
| 5,294,923 | A * | 3/1994 | Juergens et al. | 340/854.9 |
| 5,323,856 | A | 6/1994 | Davis et al. | |
| 5,404,948 | A * | 4/1995 | Fletcher | 166/250.17 |
| 5,575,333 | A | 11/1996 | Lirette et al. | 166/241.1 |
| 5,768,454 | A * | 6/1998 | Chesnoy et al. | 385/37 |
| 5,842,149 | A | 11/1998 | Harrell et al. | |
| 5,892,860 | A * | 4/1999 | Maron et al. | 385/12 |
| 5,904,037 | A * | 5/1999 | Grulick et al. | 57/264 |
| 5,960,881 | A | 10/1999 | Allamon et al. | 166/291 |
| 5,967,231 | A | 10/1999 | Laurel et al. | 166/250.04 |
| 5,986,749 | A * | 11/1999 | Wu et al. | 356/73.1 |
| 5,992,250 | A * | 11/1999 | Kluth et al. | 73/866.5 |
| 6,041,872 | A * | 3/2000 | Holcomb | 175/40 |
| 6,082,459 | A | 7/2000 | Rogers et al. | 166/334.1 |
| 6,102,126 | A | 8/2000 | Huber et al. | 166/373 |
| 6,125,935 | A | 10/2000 | Shahin, Jr. | 166/250.14 |
| 6,131,658 | A | 10/2000 | Minear | 166/250.01 |
| 6,182,764 | B1 | 2/2001 | Vaynshteyn | 166/373 |
| 6,253,842 | B1 * | 7/2001 | Connell et al. | 166/66 |
| 6,281,489 | B1 * | 8/2001 | Tubel et al. | 250/227.14 |
| 6,302,203 | B1 | 10/2001 | Rayssiguier et al. | 166/250.01 |
| 6,333,699 | B1 | 12/2001 | Zierolf | 340/854.8 |
| 6,378,610 | B2 | 4/2002 | Rayssiguier et al. | 166/281 |
| 6,401,814 | B1 | 6/2002 | Owens et al. | 166/253.1 |
| 6,408,943 | B1 | 6/2002 | Schultz et al. | 166/285 |
| 6,429,784 | B1 | 8/2002 | Beique et al. | 340/853.2 |
| 6,439,306 | B1 | 8/2002 | Patel | 166/264 |
| 6,520,257 | B2 | 2/2003 | Allamon et al. | 166/291 |
| 6,557,630 | B2 * | 5/2003 | Harkins et al. | 166/250.01 |
| 6,585,042 | B2 * | 7/2003 | Summers | 166/64 |
| 6,634,425 | B2 * | 10/2003 | King et al. | 166/253.1 |
| 6,815,945 | B2 | 11/2004 | Biester et al. | |
| 6,847,034 | B2 | 1/2005 | Shah et al. | |
| 2002/0157828 | A1 | 10/2002 | King et al. | 166/285 |
| 2003/0010493 | A1 | 1/2003 | Hill et al. | 166/65.1 |
| 2003/0029611 | A1 | 2/2003 | Owens | 166/250.03 |
| 2003/0127232 | A1 * | 7/2003 | Bussear et al. | 166/373 |
| 2003/0164237 | A1 * | 9/2003 | Butterfield, Jr. | 166/291 |
| 2004/0047534 | A1 * | 3/2004 | Shah et al. | 385/12 |

OTHER PUBLICATIONS

U.S. Appl. No. 10/464,433, filed Jun. 18, 2003, LoGiudice, et al.

"The Final Frontier: Fiber Optics Promise Real-Time Information On Well Drilling," *GTI Journal*, Winter/Spring 2002.

GTI's Friction Brake.

PCT Search Report, Application No. GB 0322533.1, dated Jan. 6, 2004.

Canadian Office Action, Application No. 2,442,475, dated Feb. 21, 2006.

* cited by examiner

SMART CEMENTING SYSTEMS

BACKGROUND OF THE INVENTION

1. Field of the Invention

The present invention generally relates to apparatus and methods for completing a well. Particularly, the present invention relates to apparatus and methods for cementing operations. More particularly, the present invention relates to apparatus and methods for locating a cementing apparatus in the wellbore. More particularly still, the present invention relates to apparatus and methods for determining the amount of cement displaced.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or a liner, is run into the well. The second string is set at a depth such that the upper portion of the second string of casing overlaps the lower portion of the first string of casing. The second liner string is then fixed or "hung" off of the existing casing. Afterwards, the second casing string is also cemented. This process is typically repeated with additional liner strings until the well has been drilled to total depth. In this manner, wells are typically formed with two or more strings of casing of an ever-decreasing diameter.

The process of cementing a liner into a wellbore typically involves the use of liner wiper plugs and drill-pipe darts. Plugs typically define an elongated elastomeric body used to separate fluids pumped into a wellbore. A liner wiper plug is typically located inside the top of a liner, and is lowered into the wellbore with the liner at the bottom of a working string. The liner wiper plug has radial wipers to contact and wipe the inside of the liner as the plug travels down the liner. The liner wiper plug has a cylindrical bore through it to allow passage of fluids.

Typically, the cementing operation requires the use of two plugs and darts. When the cement is ready to be dispensed, a first dart is released into the working string. The cement is pumped behind the dart, thereby moving the dart downhole. The dart acts as a barrier between the cement and the drilling fluid to minimize the contamination of the cement. As the dart travels downhole, it seats against a first liner wiper plug and closes off the internal bore through the first plug. Hydraulic pressure from the cement above the dart forces the dart and the plug to dislodge from the liner and to be pumped down the liner together. At the bottom, the first plug seats against a float valve, thereby closing off fluid flow through the float valve. The pressure builds above the first plug until it is sufficient to cause a membrane in the first plug to rupture. Thereafter, cement flows through the first plug and the float valve and up into the annular space between the wellbore and the liner.

After a sufficient volume of cement has been placed into the wellbore, a second dart is deployed. Drilling mud is pumped in behind the second dart to move the second dart down the working string. The second dart travels downhole and seats against a second liner wiper plug. Hydraulic pressure above the second dart forces the second dart and the second plug to dislodge from the liner and they are pumped down the liner together. This forces the cement ahead of the second plug to displace out of the liner and into the annulus. This displacement of the cement into the annulus continues until the second plug seats against the float valve. Thereafter, the cement is allowed to cure before the float valve is removed.

During the cementing operation, it is desirable to know the location of the second plug/dart in the wellbore. Generally, the position of the plug will indicate the amount of cement that has been displaced into the annulus. If insufficient cement is displaced ("underdisplacement"), cement will remain in the casing. If too much cement is displaced, ("overdisplacement"), portions of annulus will not be cemented.

One method of determining the plug location is by measuring the volume displaced after the second plug is released. Then, the volume displaced is compared to the calculated displacement volume based upon the dimensions of the casing or drill pipe. A second method is attaching an indication wire to indicate that a plug has been released. The indication wire is usually 2 to 3 feet in length. A third method is using mechanical flipper indicator. In this method, a lever is disposed below the plug container. A released plug will shift the lever when the plug travels by it. A fourth method is using electromagnetic or magnetic signals. Generally, an identification tag is attached to the plug or dart. A detector located below the cementing head picks up the signal when the plug passes to indicate that the plug has been launched.

There are drawbacks to using these methods to determine plug location. For instance, the displacement method is not very accurate and does not give a positive indication that the plug is moving at the same rate as the fluid being pumped behind the plug. Casing and drill pipe are generally manufactured to dimensional tolerances that could result in a substantial difference between the calculated displacement volume and the actual displacement volume. Further, fluids are subject to aeration and compression during the operation, thereby affecting measured volume. Indicator wires and mechanical flipper indicators only indicate that the plug has been released, not the location thereof. Finally, the signal detectors cannot track the plug for long distances and only indicate that the plug has moved past the detection device.

There is a need, therefore, for an apparatus for locating a plug in the wellbore. Further, there is a need for an apparatus for determining the amount of cement that has been displaced. The need also exists for a method for completing a cementing operation.

SUMMARY OF THE INVENTION

The present invention provides an apparatus for determining the location of an object in a wellbore. The apparatus includes a conveying member operatively connected to an object released downhole. The apparatus may also include a dispensing apparatus coupled to one end of the conveying member. Preferably, the conveying member is a fiber optics line capable of transmitting optical signals. Other types of conveying member include a wire, a tube, and a cable. Additionally, a sensor may be disposed on the object and connected to the conveying member.

In another aspect, the present invention provides a method for determining the location of an apparatus in a wellbore. The method includes lowering the apparatus with a conveying member and measuring a parameter associated with the conveying member. Thereafter, the measured parameter is used to determine the location of the apparatus. In one embodiment, the apparatus includes a cementing apparatus such a dart or a plug.

In another aspect, the method includes connecting one end of a fiber optics line to the apparatus and coupling the other end of the fiber optics line to a dispensing tool. Thereafter, the apparatus is placed in the wellbore and the length of fiber optics line is measured to determine the location of the apparatus in the wellbore.

In another aspect still, the present invention provides a method for determining a condition in a wellbore. The method includes connecting one end of a fiber optics line to an object to be lowered into the wellbore and coupling the other end of the fiber optics line to a dispensing tool. Additionally, one or more optical sensors are operatively coupled to the fiber optics line. Thereafter, the object is placed in the wellbore. Finally, one or more optical signals are sent along the fiber optics line to the one or more optical sensors and a change in the one or more optical signals is measured.

In another aspect still, the present invention provides a method for operating an apparatus in a wellbore. The method includes connecting a fiber optics line to the apparatus, connecting a signal source to the fiber optics line, and connecting a controller to the fiber optics line. Thereafter, an optical signal is sent along the fiber optics line to the controller to operate the apparatus.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
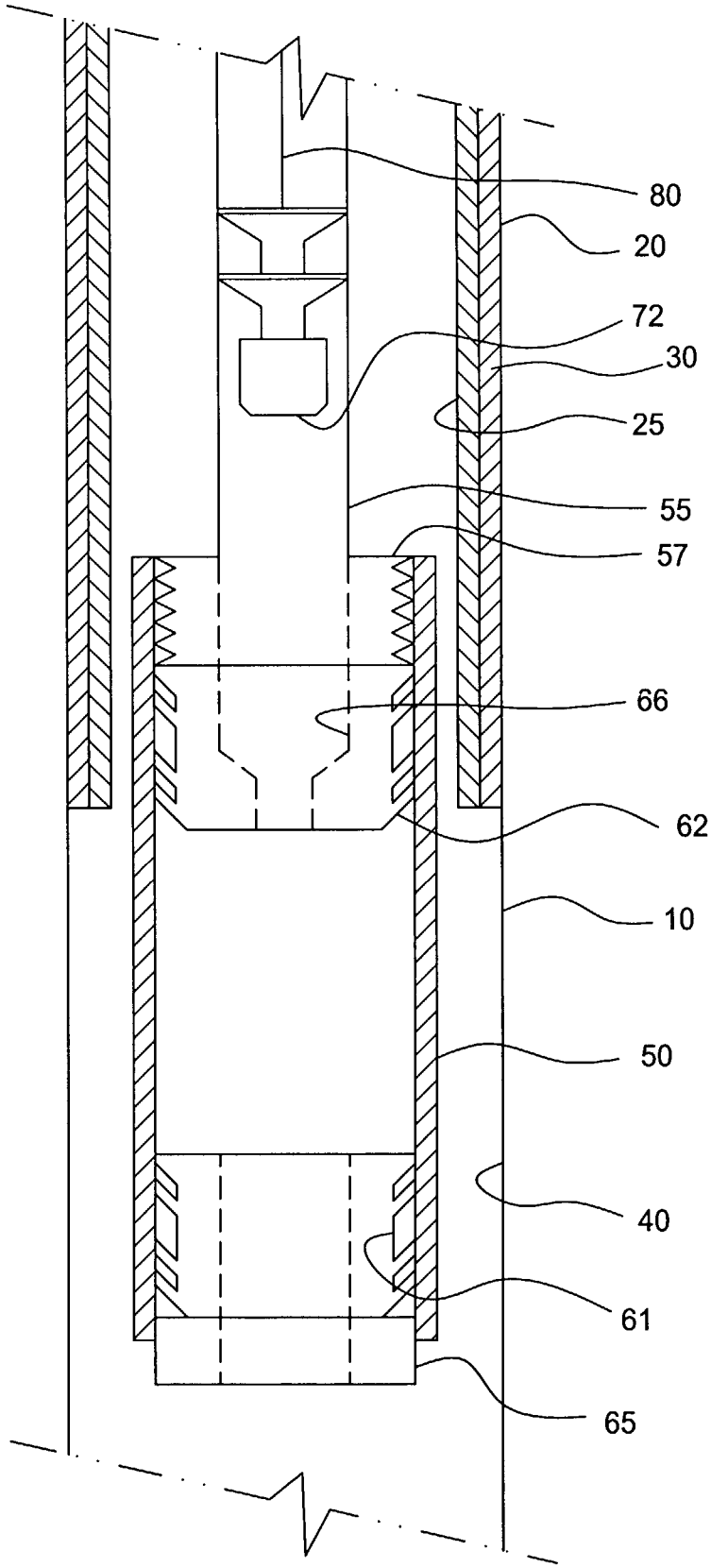
FIG. 1 is a schematic view of an apparatus according to one aspect of the present invention disposed in a partially cased wellbore. In this view, a dart is moving towards a plug.

FIG. 1 is a schematic view of a partially cased wellbore 10. In this view, an upper portion 20 of the wellbore 10 has been lined with casing 25, and the annular area between the casing 25 and the wellbore 10 has been filled with cement 30. Additionally, a lower portion 40 of the wellbore 10 is in the process of being lined with a tubular 50.

The tubular 50 is a liner 50 disposed adjacent the lower portion 40 of the wellbore 10 and at least partially overlapping the existing casing 25. The liner 50 is attached to a liner running tool 57. As shown, a first plug 61 having a first dart (not shown) seated therein has traveled down the liner 50 and seated in a float valve 65 disposed at a lower portion of the liner 50. Further, a membrane in the first plug 61 has ruptured, thereby allowing fluid communication between an interior of the liner 50 and the wellbore 10. Disposed at an upper portion of the liner running tool 57 is a second plug 62. The second plug 62 is selectively connected to the liner 50 until it is ready for release downhole. The second plug 62 contains an internal bore 66 for fluid flow and a seat for mating with a second dart 72.

The second dart 72 is shown moving along the liner running string 55. The second dart 72 is moved along the liner running string 55 by a wellbore fluid such as drilling mud that is pumped in behind the second dart 72. The second dart 72 separates the cement from the drilling mud to minimize contamination of the cement. As the second dart 72 moves along the liner running string 55, the cement in front of the second dart 72 is displaced into the wellbore 10.

Figure 2:
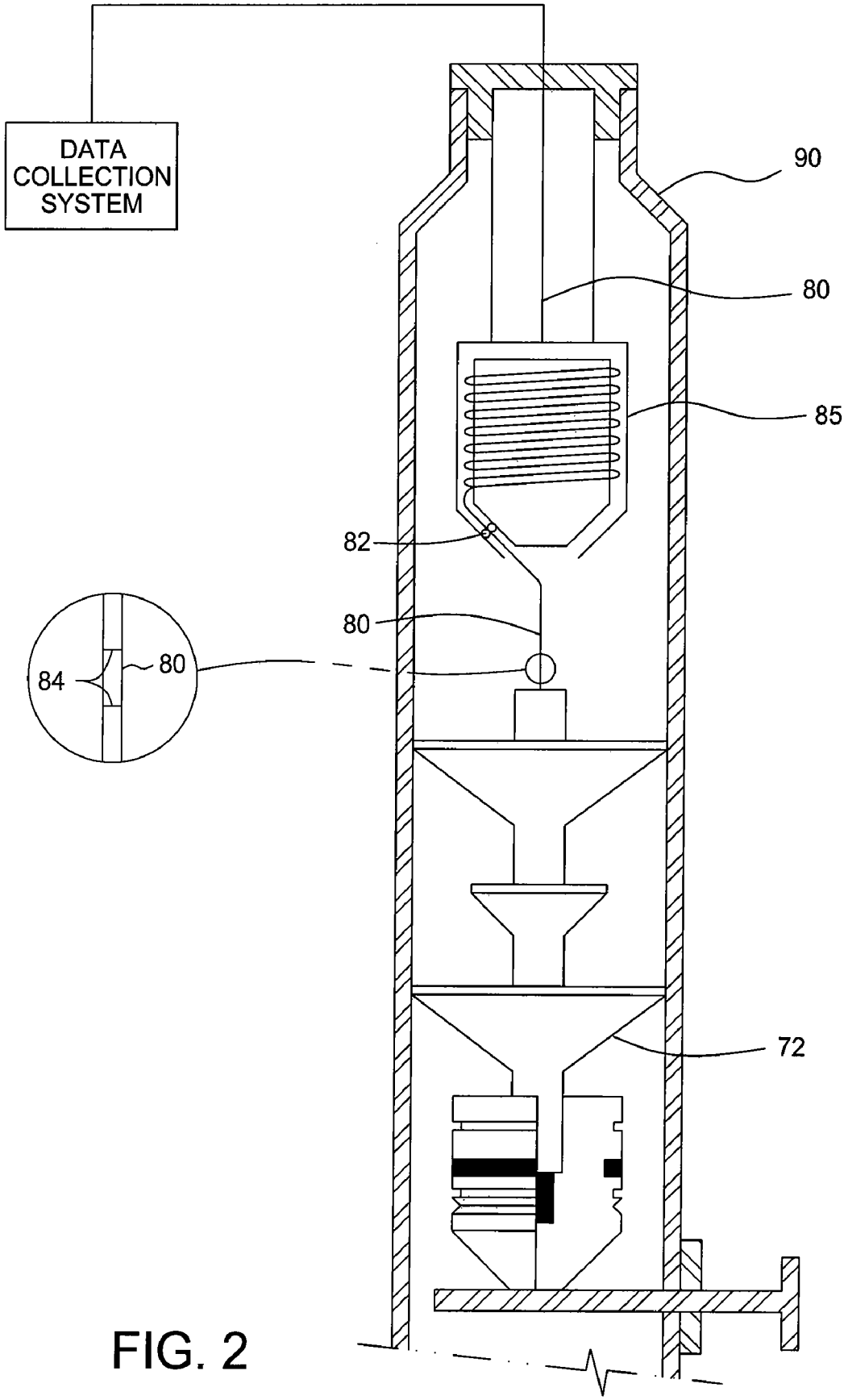
FIG. 2 is a schematic view of a dispensing apparatus usable with the present invention.

An optic fiber line 80 (or "fiber") is attached to an upper portion of the second dart 72. The other end of the fiber 80 is coupled to a dispensing apparatus 85 disposed at the surface as shown in FIG. 2. Preferably, a tension is maintained in the fiber 80 such that a fiber 80 remains substantially straight or taut as the fiber 80 is dispensed. As the second dart 72 moves downhole, a corresponding length of fiber 80 is dispensed from the dispensing apparatus 85. In this manner, the location of the second dart 72 may be determined in real time. Although a dart or plug is used herein, the aspects of the present invention are equally applicable to determining the location of other objects downhole including, but not limited to, perforating guns, retrievable packer, and other objects as known by one of ordinary skill in the art.

FIG. 2 is an exemplary dispensing apparatus 85 usable with the present invention. The dispensing apparatus 85 is disposed inside a cementing head 90 along with the second dart 72. In this view, the second dart 72 has not been released into the wellbore 10. As shown, one end of the fiber 80 is attached to the second dart 72 and another end coupled to the dispensing apparatus 85. The dispensing apparatus 85 contains a release mechanism designed to dispense a length of fiber 80 that corresponds to the distance traveled by the second dart 72. In this respect, the amount of fiber 80 dispensed is a measurement of the linear displacement of the second dart 72. Consequently, the location of the second dart 72 can be tracked by determining the amount of fiber 80 dispensed. In another embodiment, the dispensing apparatus 85 may be placed outside of the cementing head. It must be noted that other types of dispensing apparatus 85 may be used with the aspects of the present invention; for example, one such dispensing apparatus 85 is manufactured by Gas Technology Institute.

The fiber 80 may be provided with markings 84 to facilitate the reading of the length dispensed. Alternatively, one or more rollers 82 may be disposed below the dispensing apparatus. As the fiber is dispensed, it will cause the roller to rotate a respective distance. The length of the fiber dispensed may be calculated from the number of revolutions made by the roller. Other methods of measuring the length of fiber dispensed known to a person of ordinary skill in the art are contemplated within the scope of the present invention.

One advantage of using optic fiber line 80 is its size. Generally, the fiber 80 has a smaller outer diameter than other wire products such as a wireline. As such, any fiber 80 remaining in the wellbore 10 can easily be drilled out, thereby minimizing any problems associated with materials left in the wellbore 10. Additionally, optic fiber lines 80 are tolerant of high temperatures and corrosive environments, and thus have broad application in the oil industry. Although an optic fiber line 80 is used herein, it must be noted that the present invention also contemplates the use of similar small diameter wire transmission lines.

In operation, after a desired amount of cement has been introduced into the wellbore 10, the second dart 72, with the optic fiber line 80 attached, is released behind the cement. Thereafter, drilling mud is pumped in behind the second dart 72 to move the second dart 72 downhole as shown in FIG. 1. As the second dart 72 travels down the wellbore 10, cement in front of the second dart 72 is displaced out of the liner 50 and into the wellbore 10. Additionally, more fiber 80 is dispensed as the second dart 72 travels lower. Preferably, the tension in the fiber 80 is sufficient to maintain the fiber 80 substantially straight or taut. Consequently, the location of the second dart 72 can be determined from the length of fiber 80 dispensed.

The second dart 72 continues to move down the wellbore 10 until it seats in the second plug 62. This stops the second dart's 72 movement in the wellbore 10, thereby causing the fluid pressure behind the second dart 72 and the second plug 62 to build. At a predetermined level, the fluid pressure causes the second plug 62 to disconnect from the liner 50 and move down the liner 50 together with the second dart 72 and the fiber 80.

Figure 3:
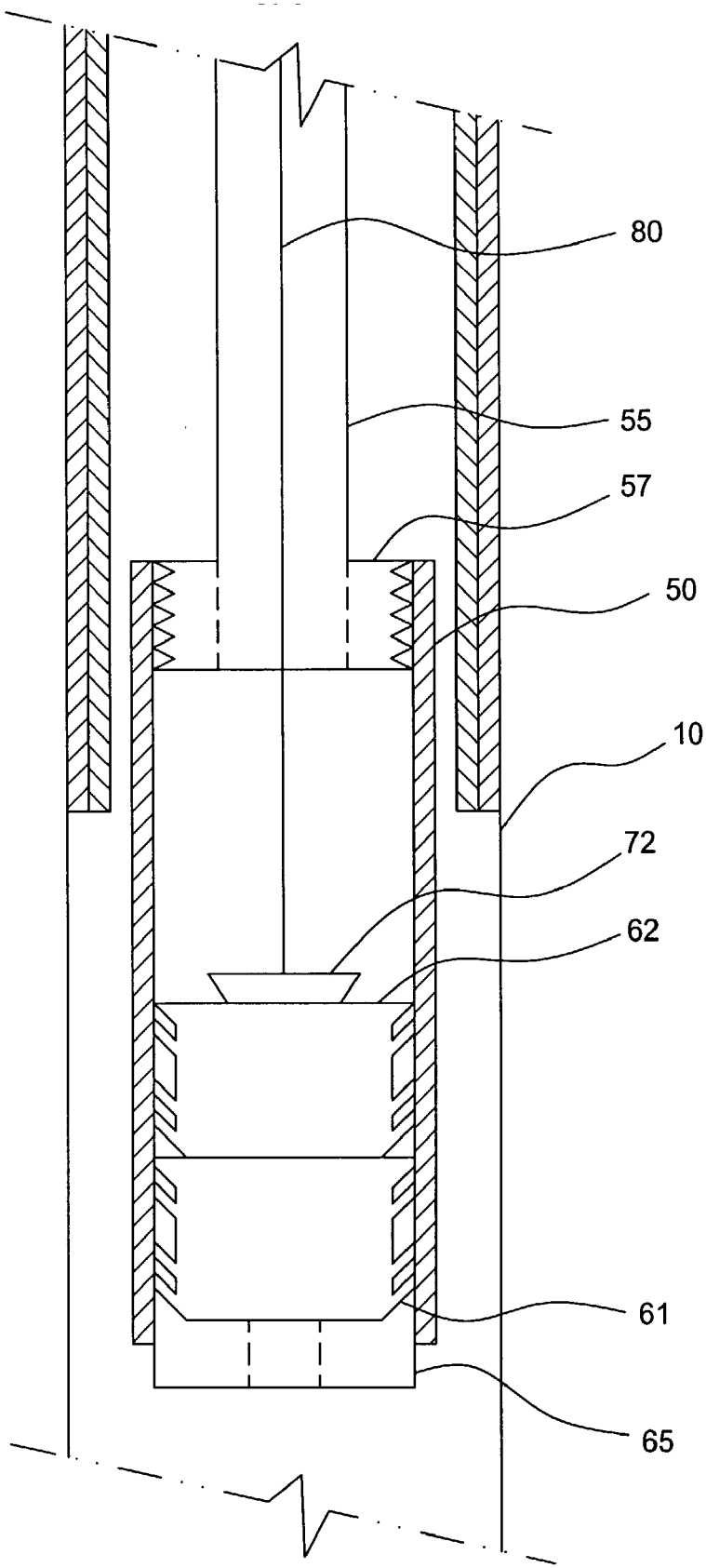
FIG. 3 is a schematic view of the apparatus of FIG. 1. In this view, the dart and the plug has moved to a lower portion of the wellbore.

FIG. 3 shows the second plug 62 engaged with the first plug 61, thereby blocking off fluid communication between the interior of the liner 50 and the wellbore 10. In this view, all or substantially all of the cement have been displaced into the wellbore 10. Additionally, cement is prevented from flowing back into the liner 50 through the float valve 65. Once the second plug 62 is stationary, an operator at the surface can compare the approximate distance between the surface and the float valve 65 to the length of fiber 80 dispensed. In this manner, the operator is provided with a positive indication that the second plug 62 has successfully reached the bottom of the liner 50. The operator may then discontinue supplying the drilling mud into the wellbore 10. When the cement cures, the darts 72, plugs 61, 62, float valve 65, and fiber 80 are drilled out.

Other applications of the present invention include attaching the fiber optic line to a dart that lands on a plug attached to a subsea casing hanger running tool. Additionally, if the cementing operation does not require the use of darts, the fiber optic line may be attached to one or more cementing plugs that are launched from the surface. It must be noted that aspects of the present invention are not limited to cementing operations, but are equally applicable to other types of wellbore operations requiring the release of an apparatus downhole.

In another aspect, the optic fiber line 80 may provide data regarding the wellbore 10 conditions. Generally, elastic properties inherent in the optic fiber 80 may complicate a reading of the length of fiber 80 dispensed. In operation, the fiber 80 may elongate or strain under the weight of the plug 62 or the drilling mud behind the plug 62. Therefore, a true indication of the location of the plug 62 may not be achieved by reading the length of fiber 80 dispensed. Although a plug 62 is used herein, aspects of the present invention are equally applicable to determining locations or positions of other apparatus disposed downhole.

Figure 4:
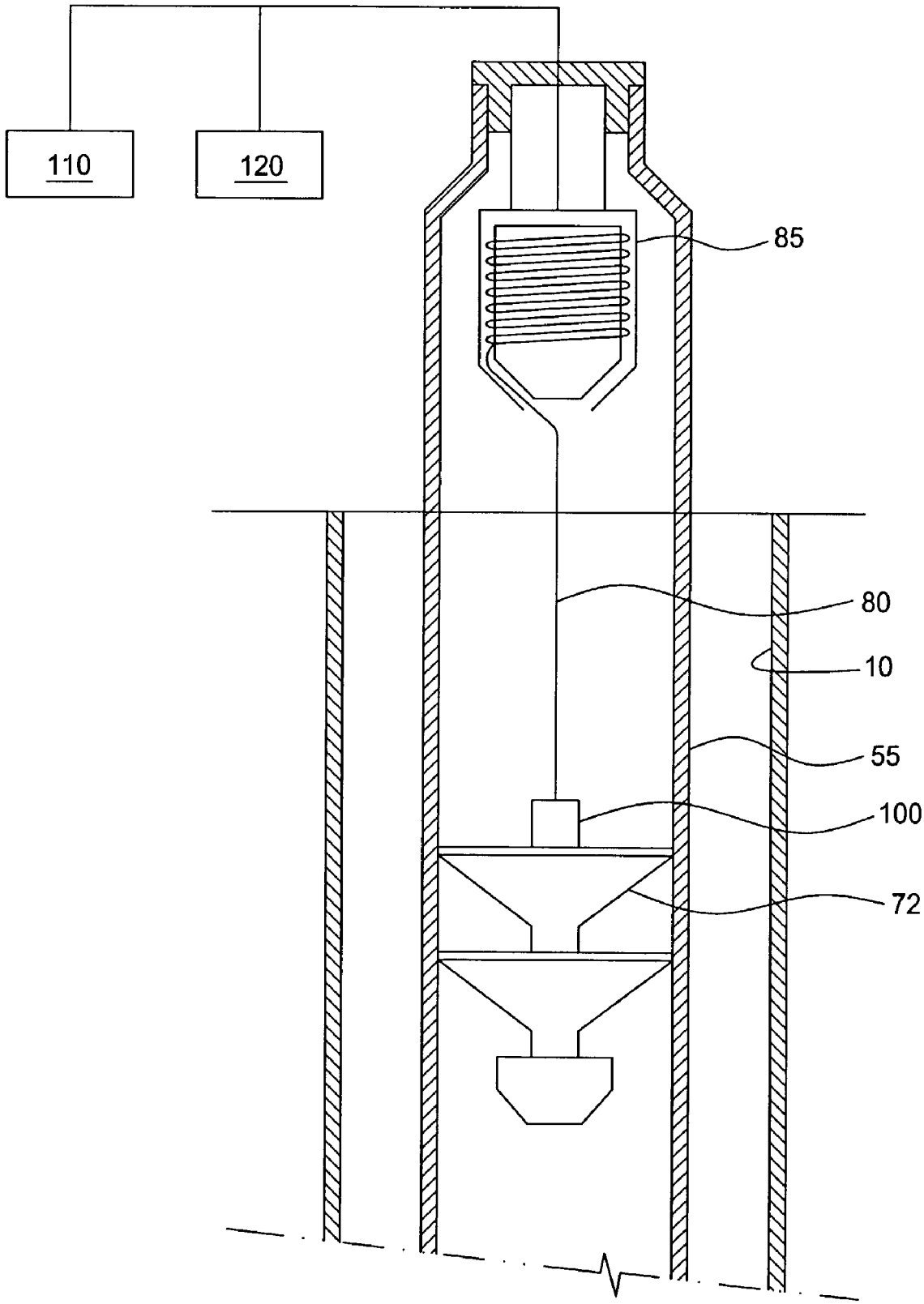
FIG. 4 is a schematic view of another aspect of the present invention. In this view, the optic fiber is provided with an optical sensor.

In one embodiment, the fiber optics line 80 may be equipped with one or more sensors 100 to provide a more accurate indication of the location of the dart 72. As illustrated in FIG. 4, a single discrete sensor 100 may be disposed on the fiber 80 at a location near the dart 72. The dart 72 is shown traveling in a running string 55 and coupled to a dispensing apparatus 85 disposed at the surface. In addition to the dispensing apparatus 85, the fiber 80 may also be connected to an optical signal source 110 and a receiver 120. An optical signal sent from the surface must travel the full distance along the fiber 80 to reach the sensor 100. Typically, the distance can be determined by measuring the total time required for the signal to travel from the optical signal source 110 to the sensor 100 and then to the receiver 120. Because the total length of fiber 80 and the amount of fiber 80 dispensed are known, any elongation of the fiber 80 due to strain may be adequately accounted for. As a result, the location of the dart 72 may be determined in real time.

Moreover, the sensor 100 may also provide a means for determining the movement of the dart 72, namely, whether it's moving or stationary. As more fiber 80 is dispensed, the fiber 80 will continue to elongate due to strain on the fiber 80. The length of the elongated portion of fiber 80 may be measured by the sensor 100. Thus, if the length of the fiber 80 continues to change due to strain as measured by the sensor 100, it may indicate that the dart 72 is moving along the wellbore. If no change in the length of the fiber 80 is measured, then it may indicate that the dart 72 has stopped moving in the wellbore.

In addition to measuring location and movement, the sensor 100 may be designed to provide real time data regarding other parameters such as pressure, temperature, strain, and/or other monitored parameters of the wellbore 10. Generally, perturbations in these parameters induce a phase shift in the optical signal, which is transmitted by the sensor 120. When the receiver 120 receives the signal, the phase shift is detected an intensity variation. The phase shift is converted into the intensity change using interferometric techniques such as Mach-Zehnder, Michelson, Fabry-Perot, and Sagnac.

In another embodiment, multiple optical sensors 100 may be arranged in a network or array configuration with individual sensors multiplexed using time division multiplexing or frequency division multiplexing. The network of sensors may provide an increased spatial resolution of temperature, pressure, strain, or flow data in the wellbore 10. One form of sensor networks is known as distributed sensing. Distributed sensor schemes typically include Bragg grating sensors and optical time domain reflectometry ("OTDR"). For example, Bragg grating sensors may be formed in one or more positions along the length of the fiber 80. These sensors provide real time data at each of these positions, which can be processed to give a clearer picture of the conditions along the length of the wellbore 10. In another example, Raman OTDR may be used to collect temperature data to provide a temperature gradient inside the wellbore 10. In another example still, Brillouin OTDR may be used to measure the strain of the fiber 80 and the temperature inside the wellbore 10. It is contemplated that other schemes of optical sensors 100 may be used without departing from the aspects of the present invention.

The location of a dart 72 may be determined from the pressure or temperature surrounding dart 72 in wellbore. As the dart 72 descends in the wellbore, the pressure or temperature of the dart 72 changes relative to the depth of the wellbore. This change in pressure or temperature may be measured by the one or more sensors 100 attached to the dart 72. Because pressure and temperature is related to depth, the depth of the dart 72 may be determined from the pressure and/or temperature measured by the one or more sensors 100.

Figure 5:
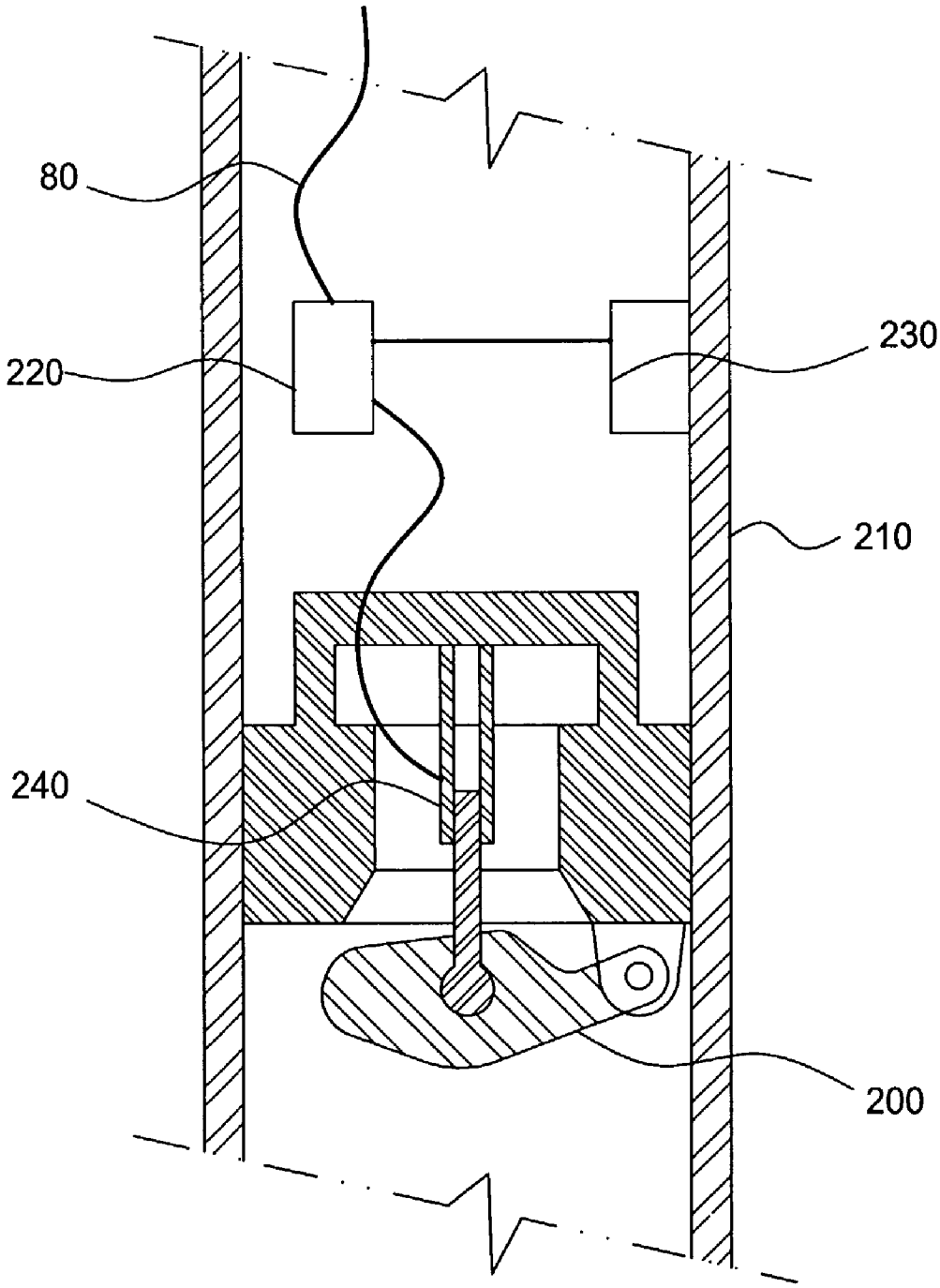
FIG. 5 is a schematic view of an apparatus according to another aspect of the present invention.

In another aspect, optic fibers 80 may be used to transmit signals to a downhole apparatus to effect the operation thereof. In one embodiment, a fiber optics line 80 may be disposed along a length of the wellbore 10. Thereafter, signals may be transmitted through the fiber 80 to operate a flapper valve 200 as illustrated in FIG. 5. FIG. 5 shows a flapper valve 200 disposed in a casing collar 210. The fiber 80 is connected to a controller 220 that, in turn, is connected to a power supply 230 and an actuator 240 of the flapper valve 200. A signal from the surface may be transmitted through the fiber 80 and processed by the controller 220. Thereafter, the controller 220 may operate the actuator 240 as directed by the signal. In this manner, a downhole flapper valve 200 may be activated by the fiber 80. In addition to the flapper valve 200, other types of downhole valves may be activated in this manner, including plunger valves and other types of float valves. The controller 220, as used herein, may be any computer or other programmable electronic device. It will be appreciated by those skilled in the art, however, that other types of controller may be used without departing from the scope of the present invention.

Figure 6:
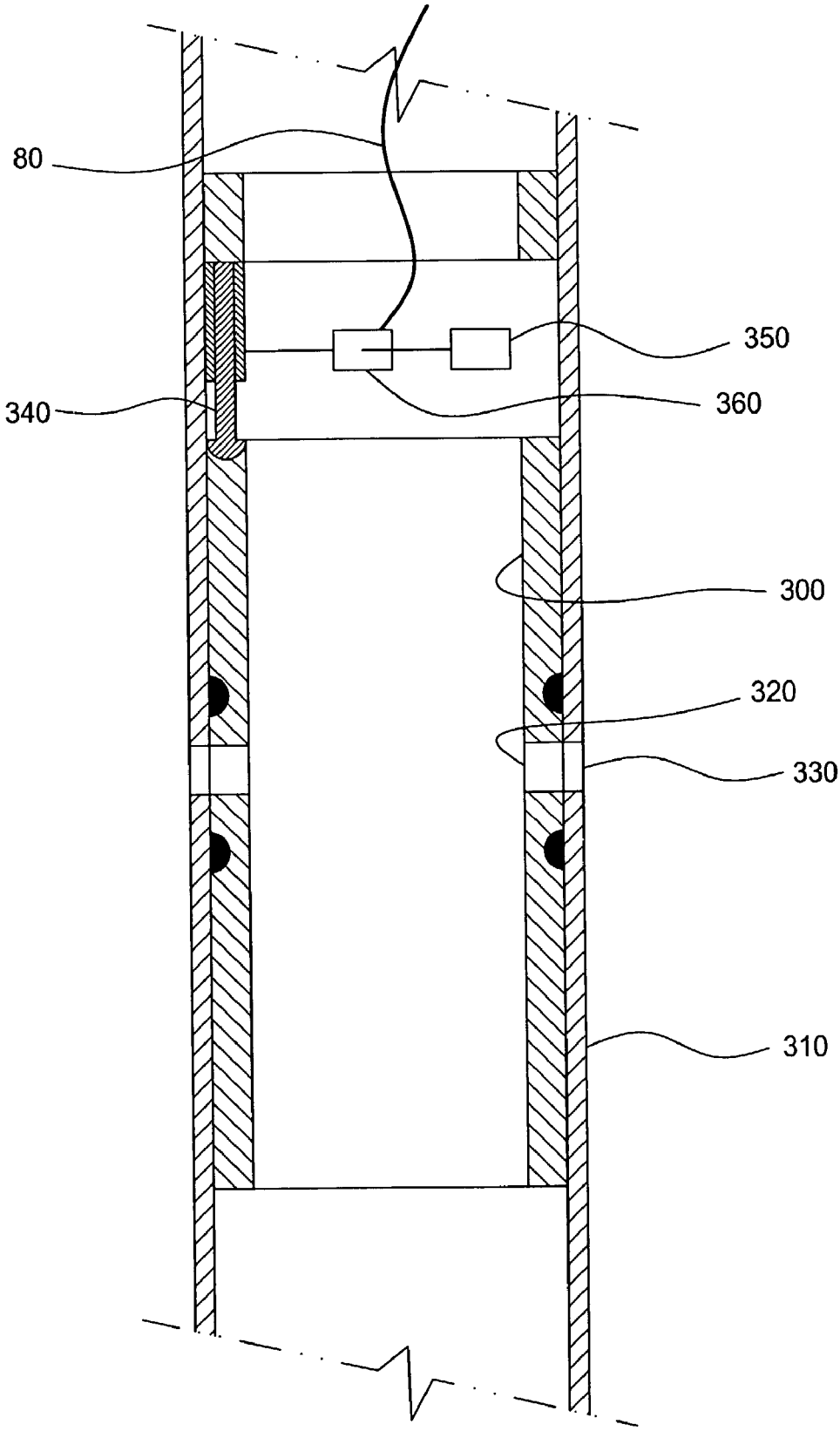
FIG. 6 is a schematic view of an apparatus according to another aspect of the present invention.

In another embodiment, fiber optics line 80 may be used to activate a sleeve 300. FIG. 6 shows a sleeve 300 disposed coaxially within a casing collar 310. The sleeve 300 is movable between an open position and a closed position and includes one or more sleeve ports 320 formed therein. In the open position, the one or more sleeve ports 320 align with one or more casing ports 330 of the casing collar 310, thereby allowing fluid communication between an interior of the casing collar 310 and an exterior of the casing collar 310. In FIG. 6, the sleeve 300 is shown in the open position. In the closed position, the sleeve ports 320 are moved out of alignment with the casing ports 330, thereby blocking fluid communication between the interior and the exterior of the casing collar 310. One or more actuators 340 are used to move the sleeve 300 between the open and closed positions. The actuator 340 is connected to a power supply 350 and operated by a controller 360 connected to the fiber 80. In this manner, signals may be transmitted through the fiber 80 to operate the sleeve 300.

In another aspect (not shown), the casing in the wellbore may be equipped with one or more magnetic or radioactive tags. The tags may be placed at predetermined positions in the casing. The tags may be used in connection with a dart having a tag sensor and an optical sensor. When the dart moves past a tag, the tag sensor may send a signal to the optical sensor. Thereafter the optical sensor may send an optical signal back to the surface through the optical fiber to indicate that the dart has moved past a certain tag in the wellbore.

In addition to fiber optics cable, aspects of the present invention also contemplate using other types of transmission lines as the conveying member for the sensor. For example, a sensor connected to a wire may be disposed on an apparatus released downhole. The wire is spooled out from the surface by the apparatus, which may include cementing equipment such as a plug or dart, during its descent. As the apparatus travels downhole, the sensor may collect and transmit data regarding the wellbore. Further, the wire may transmit the signal by electrical or non-electrical means. The sensor may collect data regarding the wellbore such as pressure and temperature. The collected data may be used to determine the location of the apparatus downhole.

In another embodiment, the conveying member may include a tube. Preferably, a sensor attached to the tube is disposed on an apparatus released downhole. The tube may transmit information using hydraulic means supplied through the tube. Additionally, a cable may be used to convey the apparatus downhole. The length of the cable dispensed may be used to determine the location the apparatus downhole.

While the foregoing is directed to embodiments of the present invention, other and further embodiments of the invention may be devised without departing from the basic scope thereof, and the scope thereof is determined by the claims that follow.

We claim:

1. A method of determining a location of an apparatus in a wellbore, comprising:

lowering a first cementing apparatus into the wellbore;

lowering a second cementing apparatus into the wellbore with a conveying member and mating the second cementing apparatus with the first cementing apparatus;

relocating both the first and the second cementing apparatus to a lower position in the wellbore;

measuring a parameter associated with the conveying member; and using the measured parameter to determine the location of the first and the second cementing apparatus, wherein the parameter is measured using a sensor and the measured parameter is selected from the group consisting of temperature, pressure, and combinations thereof.

2. The method of claim 1, wherein the parameter measured enables a determination of a length of the conveying member.

3. The method of claim 1, wherein the conveying member is selected from the group consisting of a fiber optics line, a wire, a cable, and a tube.

4. The method of claim 1, wherein one end of the conveying member is coupled to a dispensing apparatus.

5. The method of claim 1, wherein the conveying member comprises one or more optical sensors.

6. The method of claim 5, wherein the one or more optical sensors comprise distributed sensors.

7. The method of claim 6, wherein the one or more optical sensors are multiplexed.

8. The method of claim 1, wherein the conveying member is an optic fiber line that comprises one or more optical sensors configured to measure a condition in the wellbore.

9. The method of claim 8, wherein the condition is selected from the group consisting of temperature, pressure, strain, fluid flow, or combinations thereof.

10. The method of claim 1, wherein the conveying member is an optic fiber line that comprises one or more optical sensors configured to measure the strain of the optic fiber line.

11. An apparatus for measuring a parameter in a wellbore, comprising:

a dispensing apparatus disposed in a cementing head, the dispensing apparatus having one or more rollers; and a fiber optic line operatively coupled to the dispensing apparatus at one end and to a wellbore apparatus at another end, wherein information associated with the parameter is measured by optical sensors in the fiber optic line, wherein the measured parameter is a location of the wellbore apparatus and the length of the fiber optic line dispensed is determined by the one or more rollers, whereby the length of the fiber optic line relates to the location of the wellbore apparatus.

12. The apparatus of claim 11, wherein the location is a depth.

13. The apparatus of claim 11, wherein the fiber optic line comprises one or more optical sensors configured to measure the strain of the fiber optic line.

14. The apparatus of claim 11, wherein the location of the wellbore apparatus is relative to a surface of the wellbore.

15. The apparatus of claim 11, wherein the wellbore apparatus is a dart.

16. The apparatus of claim 15, wherein the fiber optic line comprises one or more optical sensors configured to measure a condition in the wellbore.

17. The apparatus of claim 16, wherein the condition is selected from the group consisting of temperature, pressure, strain, fluid flow, or combinations thereof.

18. An apparatus for determining a location of an object in a wellbore, comprising:

a dispensing apparatus disposed in a cementing head; and an optic fiber line operatively connected to the object at one end and the dispensing apparatus at another end, wherein the optic fiber includes a plurality of markings capable of indicating the amount of optic fiber dispensed and the object is selected from a group consisting of a cement plug, a dart and combinations thereof, whereby the object is movable from a first position when the object is connected to the dispensing apparatus in the cementing head and a second position when the object is released from the dispensing apparatus in the cementing head.

19. The apparatus of claim 18, wherein the line comprises one or more optical sensors.

20. The apparatus of claim 19, wherein the one or more optical sensors is configured to indicate the movement of the object relative to the wellbore.

21. The apparatus of claim 19, wherein the one or more optical sensors is configured to indicate whether the object is stationary or moving.

22. The apparatus of claim 19, wherein the one or more optical sensors comprise distributed sensors.

23. The apparatus of claim 22, wherein the one or more optical sensors are multiplexed.

24. The apparatus of claim 18, wherein the optic fiber line comprises one or more optical sensors configured to measure a condition in the wellbore.

25. The apparatus of claim 24, wherein the condition is selected from the group consisting of temperature, pressure, strain, fluid flow, or combinations thereof.

26. The apparatus of claim 24, wherein the sensors are arranged in a network or array configuration.

27. The apparatus of claim 18, wherein the plurality of markings is Bagg grating.

28. The apparatus of claim 18, wherein the optic fiber line comprises one or more optical sensors configured to collect temperature data for use in providing a temperature gradient inside the wellbore.

29. The apparatus of claim 18, wherein the optic fiber line comprises one or more optical sensors configured to measure the strain of the optic fiber line.

* * * * *